US006164648A

United States Patent [19]

Everett

[11] Patent Number: 6,164,648

[45] Date of Patent: Dec. 26, 2000

[54] DOMINOES STARTING TEMPLATE

[76] Inventor: Leona J. Everett, deceased, late of Albany, Oreg., by George Everett, administrator

[21] Appl. No.: 09/238,908

[22] Filed: Jan. 28, 1999

[51] Int. Cl.[7] ..... A63F 1/10; A63F 9/20

[52] U.S. Cl. ..... 273/148 R; 273/148 A; 273/150; 273/309; D21/392; D21/396

[58] Field of Search ..... 273/148 R, 309, 273/150, 198 A, 293, 151, 148 A; D21/391, 392, 393, 396, 397

[56] References Cited

U.S. PATENT DOCUMENTS

| | | | |
|---|---|---|---|
| D. 420,709 | 2/2000 | Trent et al. | D21/392 |
| 3,826,500 | 7/1974 | Stratta | 273/151 |
| 4,273,338 | 6/1981 | Yaeger | 273/282 |

OTHER PUBLICATIONS

Puremco: The World's Finest Dominoes, "Domino Centerpiece", www.puremcodominoes.com, Jun. 2000.

Game Gallery Online, "Chickenfoot", "Mexican Train", store.yahoo.com/toyworld1/, Jun. 2000.

Amazon.com, "Double Six Color Dot Dominoes In Color Collectors Tin", Cardinal Industries, Jun. 2000.

Domino King, "Deluxe Chickenfoot", "Mexican Train", "Wildstar", "PiP Domino games", www.laser–pointer.com., Jun. 2000.

AreYouGame.com, "Collectors Dominoes—Double Fifteen" by Cardinal, Jun. 2000.

"Spoiler", "Wildstar", "Mexican Train", "Deluxe—Chickenfoot", www.dfbilliards.com/dominoes, Jun. 2000.

The Domino Guy, "Deluxe Chickenfoot", "Mexican Train", "Wildstar", www.thedominoguy.com., Jun. 2000.

*Primary Examiner*—Benjamin H. Layno

[57] ABSTRACT

A dominoes starting template for providing a location for each player of a multiple-player game of dominoes a location for laying their dominoes during play. The template includes a plate having first and second surfaces, and a number of sides. The plate has a spinner hole therethrough between the first and second surfaces of the plate sized to receive a domino therein. Each of the sides of the plate has a pair of cutouts therethrough between the first and second surfaces of the plate. Each cutout of the pair of cutouts of each of the sides of the plate is sized for receiving an end portion of a domino therein.

16 Claims, 2 Drawing Sheets

DOMINOES STARTING TEMPLATE

BACKGROUND OF THE INVENTION

1. Field of the Invention

The present invention relates to domino playing aids and accessories and more particularly pertains to a new dominoes starting template for providing a location for each player of a multiple-player game of dominoes a location for laying their dominoes during play.

2. Description of the Prior Art

The use of domino playing aids and accessories is known in the prior art. More specifically, domino playing aids and accessories heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,225,139; U.S. Pat. No. 5,346,225; U.S. Pat. No. 278,646; U.S. Pat. No. 4,285,522; U.S. Pat. No. 3,330,053; and U.S. Pat. No. Des. 338,243.

While these devices fulfill their respective, particular objectives and requirements, the aforementioned patents do not disclose a new dominoes starting template. The inventive device includes a plate having first and second surfaces, and a number of sides. The plate has a spinner hole therethrough between the first and second surfaces of the plate sized to receive a domino therein. Each of the sides of the plate has a pair of cutouts therethrough between the first and second surfaces of the plate. Each cutout of the pair of cutouts of each of the sides of the plate is sized for receiving an end portion of a domino therein.

In these respects, the dominoes starting template according to the present invention substantially departs from the conventional concepts and designs of the prior art, and in so doing provides an apparatus primarily developed for the purpose of providing a location for each player of a multiple-player game of dominoes a location for laying their dominoes during play.

SUMMARY OF THE INVENTION

In view of the foregoing disadvantages inherent in the known types of domino playing aids and accessories now present in the prior art, the present invention provides a new dominoes starting template construction wherein the same can be utilized for providing a location for each player of a multiple-player game of dominoes a location for laying their dominoes during play.

The general purpose of the present invention, which will be described subsequently in greater detail, is to provide a new dominoes starting template apparatus and method which has many of the advantages of the domino playing aids and accessories mentioned heretofore and many novel features that result in a new dominoes starting template which is not anticipated, rendered obvious, suggested, or even implied by any of the prior art domino playing aids and accessories, either alone or in any combination thereof.

To attain this, the present invention generally comprises a plate having first and second surfaces, and a number of sides. The plate has a spinner hole therethrough between the first and second surfaces of the plate sized to receive a domino therein. Each of the sides of the plate has a pair of cutouts therethrough between the first and second surfaces of the plate. Each cutout of the pair of cutouts of each of the sides of the plate is sized for receiving an end portion of a domino therein.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new dominoes starting template apparatus and method which has many of the advantages of the domino playing aids and accessories mentioned heretofore and many novel features that result in a new dominoes starting template which is not anticipated, rendered obvious, suggested, or even implied by any of the prior art domino playing aids and accessories, either alone or in any combination thereof.

It is another object of the present invention to provide a new dominoes starting template which may be easily and efficiently manufactured and marketed.

It is a further object of the present invention to provide a new dominoes starting template which is of a durable and reliable construction.

An even further object of the present invention is to provide a new dominoes starting template which is susceptible of a low cost of manufacture with regard to both materials and labor, and which accordingly is then susceptible of low prices of sale to the consuming public, thereby making such dominoes starting template economically available to the buying public.

Still yet another object of the present invention is to provide a new dominoes starting template which provides in the apparatuses and methods of the prior art some of the advantages thereof, while simultaneously overcoming some of the disadvantages normally associated therewith.

Still another object of the present invention is to provide a new dominoes starting template for providing a location for each player of a multiple-player game of dominoes a location for laying their dominoes during play.

Yet another object of the present invention is to provide a new dominoes starting template which includes a plate having first and second surfaces, and a number of sides. The plate has a spinner hole therethrough between the first and second surfaces of the plate sized to receive a domino therein. Each of the sides of the plate has a pair of cutouts therethrough between the first and second surfaces of the plate. Each cutout of the pair of cutouts of each of the sides of the plate is sized for receiving an end portion of a domino therein.

Still yet another object of the present invention is to provide a new dominoes starting template that allows up to eight players to lay their dominoes on the playing surface from a spinner or starting domino.

Even still another object of the present invention is to provide a new dominoes starting template that allows easier and clearer positioning of dominoes in a multiple-player game of dominoes.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
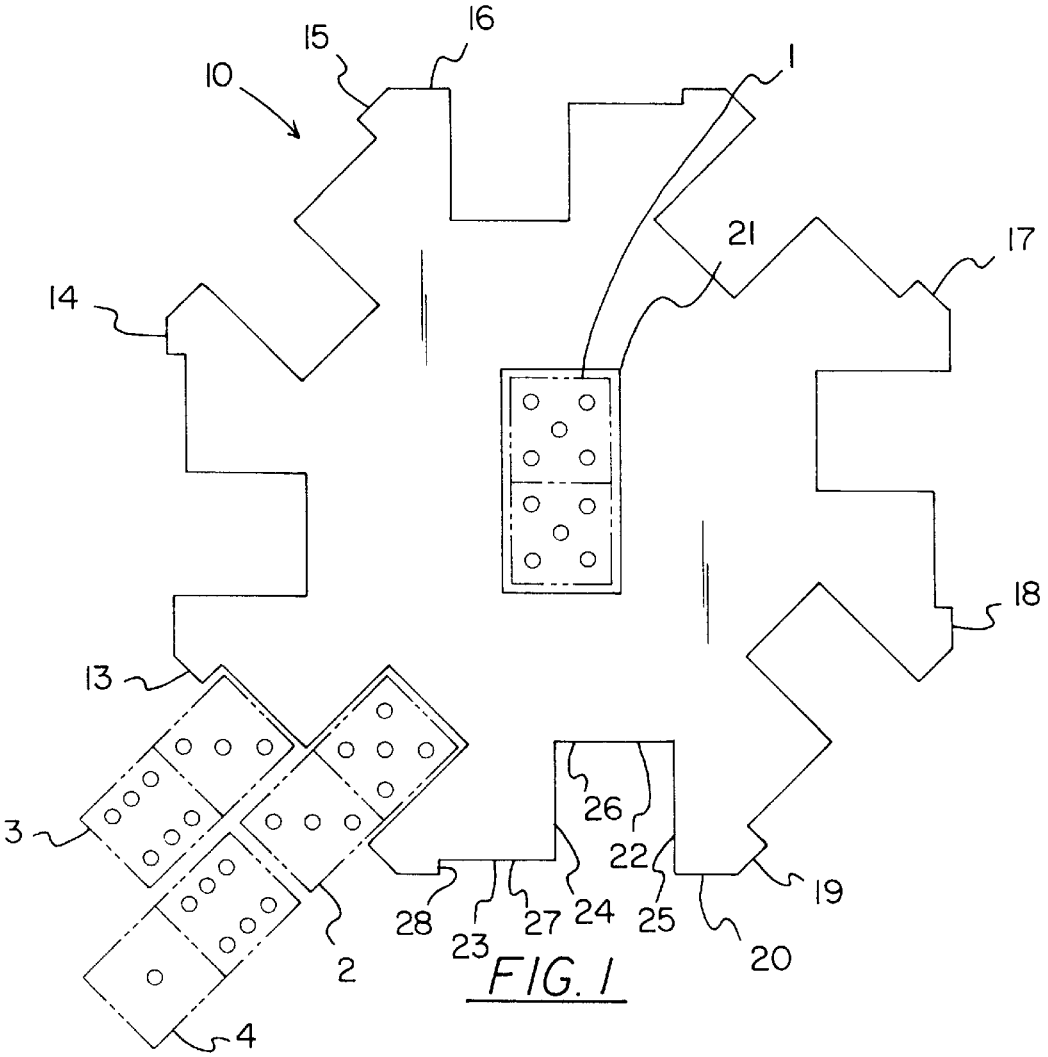
FIG. 1 is a schematic top side view of the main plate of a new dominoes starting template according to the present invention.

With reference now to the drawings, and in particular to FIGS. 1 through 4 thereof, a new dominoes starting template embodying the principles and concepts of the present invention and generally designated by the reference numeral 10 will be described.

As best illustrated in FIGS. 1 through 4, the dominoes starting template 10 10 generally comprises a plate 10 having first and second surfaces 11, 12, and a number of sides 13, 14, 15, 16, 17, 18, 19, 20. The plate 10 has a spinner hole 21 therethrough between the first and second surfaces 11, 12 of the plate 10 sized to receive a domino 1 therein. Each of the sides 13, 14, 15, 16, 17, 18, 19, 20 of the plate 10 has a pair of cutouts 22, 23 therethrough between the first and second surfaces 11, 12 of the plate 10. Each cutout of the pair of cutouts 22, 23 of each of the sides of the plate is sized for receiving an end portion 2, 3 of a domino therein.

In closer detail, the plate 10 is generally octagonal and has substantially flat first and second surface 12, a center, and eight generally straight sides 13, 14, 15, 16, 17, 18, 19, 20 of generally equal length. The plate 10 has a generally rectangular spinner hole 21 therethrough between the first and second surfaces 11, 12 of the plate 10. The spinner hole 21 is sized to receive a domino 1 therein. In use, a spinner or starting domino 1 having a double value (that is, each half of the spinner domino has the same number value or dots thereon) is inserted into the spinner hole 21 to start a traditional game of dominoes. Preferably, the spinner hole 21 of the plate 10 is centrally positioned on the plate 10. The spinner hole 21 has a plurality of sides that are each ideally extended generally parallel to an adjacent side of the plate 10.

Each of the sides 13, 14, 15, 16, 17, 18, 19, 20 of the plate 10 has a pair of cutouts 22, 23 therethrough between the first and second surfaces 11, 12 of the plate 10. Each cutout of the pair of cutouts 22, 23 of each of the sides 13, 14, 15, 16, 17, 18, 19, 20 of the plate 10 has a generally rectangular configuration sized for receiving an end portion of a domino therein. The pair of cutouts of each of the sides of the plate are preferably generally equally sized to the pair of cutouts of the other sides of the plate. The cutouts of the pair of cutouts 22, 23 of each of the sides 13, 14, 15, 16, 17, 18, 19, 20 of the plate 10 are preferably positioned adjacent each other such that the pair of cutouts 22, 23 of each of the sides 13, 14, 15, 16, 17, 18, 19, 20 of the plate 10 have a coextensive periphery. The coextensive periphery has a generally rectangular U-shaped portion and a generally L-shaped portion. The generally rectangular U-shaped portion of the coextensive periphery defines a first cutout 22 of the pair of cutouts of each of the sides of the plate while the generally L-shaped portion of the coextensive periphery defines a second cutout 23 of the pair of cutouts of each of the sides of the plate. In use, as illustrated in FIG. 1, the first cutout 22 is designed for receiving the end of the first domino 2 of a train of dominoes whose half adjacent that end has the same value of either half of the spinner or starting domino. The second cutout 23 is designed for receiving the end of the next domino 3 of the train of dominoes whose half adjacent that end has the same value of the other half of the first domino adjacent the distal end of the first domino. A third domino 4 of the train of dominoes may then be laid adjacent the first and second dominoes 2, 3 as shown in FIG. 1 with the value of the half of the third domino 4 positioned adjacent the matching half adjacent the distal end of the second domino 3 of the train of dominoes.

The generally rectangular U-shaped portion of the coextensive periphery of each of the sides of the plate has a pair of spaced apart side edges 24, 25 and a bottom edge 26 connecting the side edges 24, 25 together. The bottom edge 26 extends generally parallel to the length of the associated side of the plate while the side edges 24, 25 extend generally perpendicular to the associated side of the plate 10. The generally L-shaped portion of the coextensive periphery of each of the sides 13, 14, 15, 16, 17, 18, 19, 20 of the plate 10 has a long side edge 27 and a short side edge 28. The long side edge 27 preferably extends generally parallel to the associated side of the plate while the short side edge 28 preferably extends generally perpendicular to the associated side edge of the plate.

The plate 10 has a thickness defined between the first and second surfaces 11, 12 of the plate 10. Preferably, the thickness of the plate 10 is less than three quarters the thickness of a domino used with the plate 10 so that the dominoes may be easily lifted from the plate 10. Ideally, the thickness of the plate 10 is less than half the thickness of a domino used with the plate 10.

Figure 2:
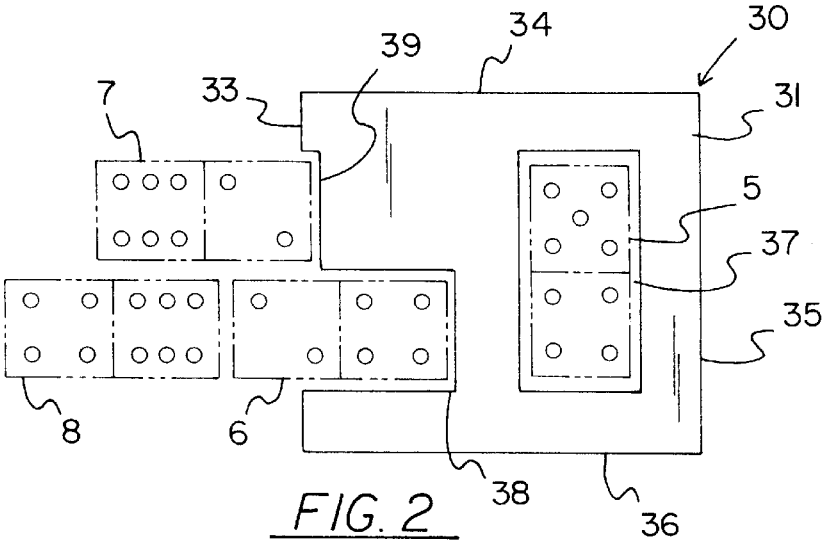
FIG. 2 is a schematic top side view of the additional secondary plate of the present invention.
Figure 3:
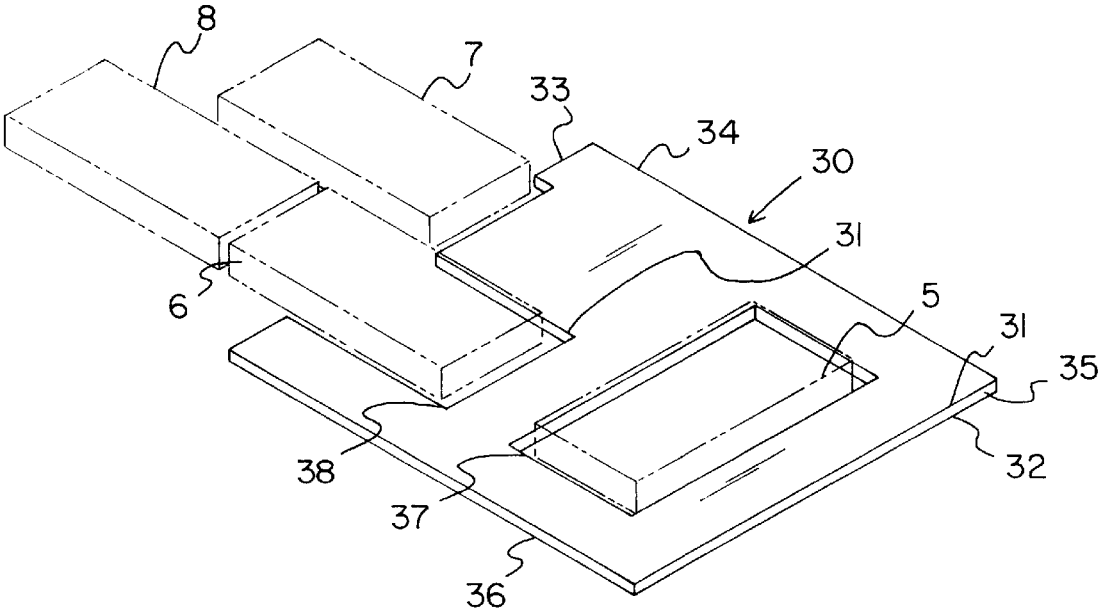
FIG. 3 is a schematic perspective view of the secondary plate of the present invention.
Figure 4:
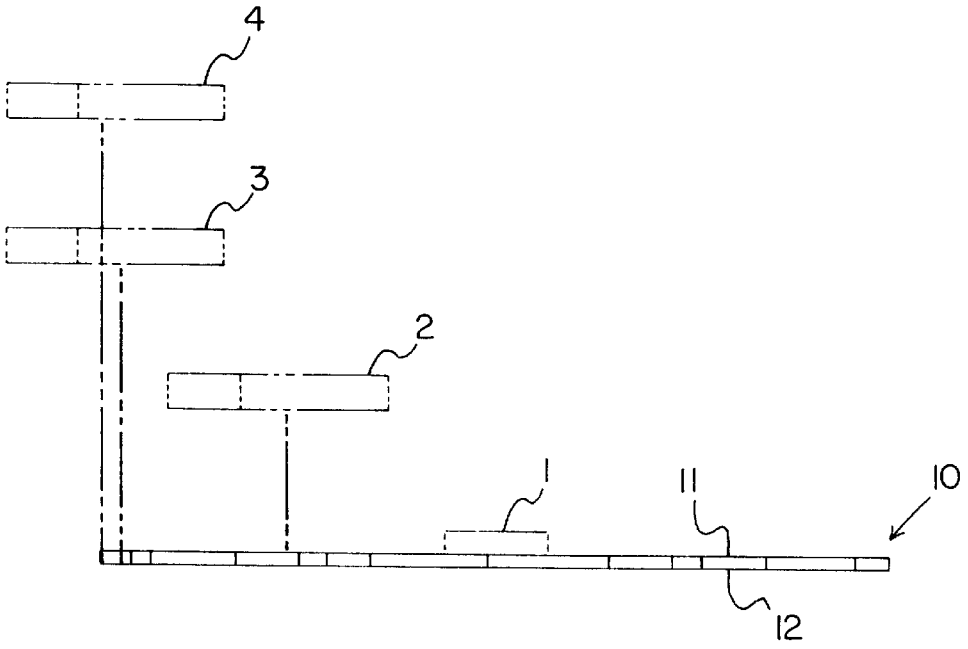
FIG. 4 is a schematic side view of the main plate of the present invention.

Additionally, a secondary plate 30 similar to the main plate 10 may be provided for domino games with more than eight players. The secondary plate 30 is generally rectangular and has first and second surfaces 31, 32, four sides 33, 34, 35, 36, a generally rectangular hole 37 sized to receive a domino 5 therein, and a pair of side cutouts 38, 39 each configured to receive an end of a domino therein 6, 7. The secondary plate 30 permits laying of an additional train of dominoes 5, 6, 7, 8 when more than eight players are playing a game of dominoes together. The hole 37 of the plate is designed for receiving a first domino 5 of a train of dominoes having a half matching the value of a half of the spinner or starting domino 1 in the main plate 10. A first of the side cutouts 38 is designed for receiving the end of a second domino 6 of the train of dominoes as illustrated in FIG. 2. A second of the side cutouts 39 is designed for receiving a third domino 7 of the train of dominos as shown in FIG. 2. A fourth domino 8 of the train of dominoes is positioned next to the third domino 7 such that the fourth domino is also adjacent the second domino 6.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A starting template for a game of dominoes, comprising:

a plate having first and second surfaces, and a number of sides;

said plate having a hole therethrough between said first and second surfaces of said plate, said hole being sized to receive a domino therein;

each of said sides of said plate having a pair of cutouts therethrough between said first and second surfaces of said plate, each cutout of said pair of cutouts of each of said sides of said plate being sized for receiving an end portion of a domino therein;

wherein said cutouts of said pair of cutouts of each of said sides of said plate are positioned adjacent each other such that said pair of cutouts of each of said sides of said plate have a coextensive periphery; and wherein said coextensive periphery has a generally rectangular U-shaped portion and a generally L-shaped portion, said generally rectangular U-shaped portion of said coextensive periphery defining a first cutout of said pair of cutouts of each of said sides of said plate, said generally L-shaped portion of said coextensive periphery defining a second cutout of said pair of cutouts of each of said sides of said plate.

2. The starting template of claim 1, wherein said plate is generally octagonal and wherein said number of sides of said plate comprises eight sides.

3. The starting template of claim 1, wherein said hole of said plate is centrally positioned on said plate, said hole having a plurality of sides, each of said sides of said hole being extended generally parallel to an adjacent side of said plate.

4. The starting template of claim 1, wherein said generally rectangular U-shaped portion of said coextensive periphery of each of said sides of said plate has a pair of spaced apart side edges and a bottom edge connecting said side edges together, said bottom edge extending generally parallel to the associated side of said plate, said side edges extending generally perpendicular to the associated side of said plate.

5. The starting template of claim 1, wherein said generally L-shaped portion of said coextensive periphery of each of said sides of said plate has a long side edge and a short side edge, said long side edge extending generally parallel to the associated side of said plate, said short side edge extending generally perpendicular to the associated side edge of said plate.

6. The starting template of claim 1, wherein said plate has a thickness defined between said first and second surfaces of said plate, wherein said thickness of said plate is less than three-quarters the thickness of a domino used with said plate.

7. The starting template of claim 6, wherein said thickness of said plate is less than half the thickness of a domino used with said plate.

8. The starting template of claim 1, further comprising a secondary plate being generally rectangular and having first and second surfaces, four sides, a generally rectangular hole sized to receive a domino therein, and a pair of side cutouts each configured to receive an end of a domino therein.

9. A starting template for a game of dominoes, comprising:

a plate being generally octagonal and having substantially flat first and second surface, a center, and a number of generally straight sides of generally equal length, said wherein said number of sides of said plate comprises eight sides;

said plate having a generally rectangular hole therethrough between said first and second surfaces of said plate, said hole being sized to receive a domino therein;

said hole of said plate being centrally positioned on said plate, said hole having a plurality of sides, each of said sides of said hole being extended generally parallel to an adjacent side of said plate;

each of said sides of said plate having a pair of cutouts therethrough between said first and second surfaces of said plate, each cutout of said pair of cutouts of each of said sides of said plate having a generally rectangular configuration sized for receiving an end portion of a domino therein;

said cutouts of said pair of cutouts of each of said sides of said plate being positioned adjacent each other such that said pair of cutouts of each of said sides of said plate have a coextensive periphery;

said coextensive periphery having a generally rectangular U-shaped portion and a generally L-shaped portion, said generally rectangular U-shaped portion of said coextensive periphery defining a first cutout of said pair of cutouts of each of said sides of said plate, said generally L-shaped portion of said coextensive periphery defining a second cutout of said pair of cutouts of each of said sides of said plate;

wherein said generally rectangular U-shaped portion of said coextensive periphery of each of said sides of said plate has a pair of spaced apart side edges and a bottom edge connecting said side edges together, said bottom edge extending generally parallel to the associated side of said plate, said side edges extending generally perpendicular to the associated side of said plate;

wherein said generally L-shaped portion of said coextensive periphery of each of said sides of said plate has a long side edge and a short side edge, said long side edge extending generally parallel to the associated side of said plate, said short side edge extending generally perpendicular to the associated side edge of said plate; and said plate having a thickness defined between said first and second surfaces of said plate, wherein said thickness of said plate is less than three quarters the thickness of a domino used with said plate.

10. A starting template for a game of dominoes, comprising:

a plate having first and second surfaces, and a number of sides;

each of said sides of said plate having a pair of cutouts therethrough between said first and second surfaces of said plate, each cutout of said pair of cutouts of each of said sides of said plate being sized for receiving an end portion of a domino therein; and wherein said cutouts of said pair of cutouts of each of said sides of said plate are positioned adjacent each other, a first one of said pair of cutouts having a first depth, a second one of said pair of cutouts having a second depth, wherein said second depth is greater than said first depth by a distance equal to one half of a length of a domino such that a first domino inserted in said first cutout is parallel and offset from a second domino inserted in said second cutout, a distance offset being equal to one half of the length of the domino.

11. The starting template of claim 10, wherein said plate is generally octagonal and wherein said number of sides of said plate comprises eight sides.

12. The starting template of claim 10, wherein said generally rectangular U-shaped portion of said coextensive periphery of each of said sides of said plate has a pair of spaced apart side edges and a bottom edge connecting said side edges together, said bottom edge extending generally parallel to the associated side of said plate, said side edges extending generally perpendicular to the associated side of said plate.

13. The starting template of claim 10, wherein said generally L-shaped portion of said coextensive periphery of each of said sides of said plate has a long side edge and a short side edge, said long side edge extending generally parallel to the associated side of said plate, said short side edge extending generally perpendicular to the associated side edge of said plate.

14. The starting template of claim 10, wherein said plate has a thickness defined between said first and second surfaces of said plate, wherein said thickness of said plate is less than three-quarters the thickness of a domino used with said plate.

15. The starting template of claim 14, wherein said thickness of said plate is less than half the thickness of a domino used with said plate.

16. The starting template of claim 10, further comprising a secondary plate being generally rectangular and having first and second surfaces, four sides, a generally rectangular hole sized to receive a domino therein, and a pair of side cutouts each configured to receive an end of a domino therein.

* * * * *